US007986083B2

(12) United States Patent
Xiao et al.

(10) Patent No.: US 7,986,083 B2
(45) **Date of Patent: *Jul. 26, 2011**

(54) ELECTRON EMITTING DEVICE WITH A GATE ELECTRODE HAVING A CARBON NANOTUBE FILM AND A CARBON NANOTUBE REINFORCEMENT STRUCTURE

(75) Inventors: Lin Xiao, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 233 days.

This patent is subject to a terminal disclaimer.

(21) Appl. No.: 12/319,048

(22) Filed: Dec. 31, 2008

(65) Prior Publication Data

US 2009/0256463 A1 Oct. 15, 2009

(30) Foreign Application Priority Data

Apr. 9, 2008 (CN) ..... 2008 1 0066517

(51) Int. Cl.
*H01J 9/02* (2006.01)
*H01J 9/00* (2006.01)
*H01J 9/40* (2006.01)

(52) U.S. Cl. ..... 313/495; 313/309; 313/497; 313/357; 313/311

(58) Field of Classification Search ..... 313/495–497, 313/306, 309–310, 351, 346 R, 336; 445/51; 977/742, 842
See application file for complete search history.

(56) References Cited

U.S. PATENT DOCUMENTS

| | | | | |
|---|---|---|---|---|
| 6,630,772 | B1 | 10/2003 | Bower et al. | |
| 6,943,493 | B2 | 9/2005 | Uemura et al. | |
| 7,319,288 | B2 | 1/2008 | Liu et al. | |
| 7,569,158 | B2 | 8/2009 | Waller et al. | |
| 2001/0019238 | A1 | 9/2001 | Dai et al. | |
| 2005/0215165 | A1 | 9/2005 | Uemura et al. | |
| 2005/0275331 | A1 | 12/2005 | Takai et al. | |
| 2006/0066202 | A1 | 3/2006 | Manohara et al. | |
| 2007/0075619 | A1 | 4/2007 | Jiang et al. | |
| 2007/0128960 | A1 * | 6/2007 | Nejhad et al. | 442/59 |
| 2008/0020499 | A1 | 1/2008 | Kim et al. | |
| 2008/0036358 | A1 | 2/2008 | Takai | |
| 2009/0115305 | A1 | 5/2009 | Segal et al. | |
| 2009/0195138 | A1 * | 8/2009 | Xiao et al. | 313/235 |
| 2009/0256462 | A1 * | 10/2009 | Xiao et al. | 313/235 |

FOREIGN PATENT DOCUMENTS

| | | |
|---|---|---|
| CN | 1428813 A | 7/2003 |
| CN | 1781968 A | 6/2006 |

* cited by examiner

*Primary Examiner* — Anne M Hines
*Assistant Examiner* — Tracie Green
(74) *Attorney, Agent, or Firm* — D. Austin Bonderer

(57) ABSTRACT

An electron emission device includes a cathode electrode and a gate electrode, the gate electrode is separated and insulated from the cathode, the gate electrode is a CNT layer, and the CNT layer includes at least a carbon nanotube film and a plurality of carbon nanotube reinforcement structures. A display that includes the electron emission device is also disclosed.

20 Claims, 7 Drawing Sheets

ELECTRON EMITTING DEVICE WITH A GATE ELECTRODE HAVING A CARBON NANOTUBE FILM AND A CARBON NANOTUBE REINFORCEMENT STRUCTURE

RELATED APPLICATIONS

This application is related to commonly-assigned applications entitled, "ELECTRON EMISSION DEVICE AND DISPLAY USING THE SAME", filed Dec. 31, 2008, application Ser. No. 12/317,999; "ELECTRON EMISSION DEVICE AND DISPLAY USING THE SAME", filed Dec. 31, 2008, application Ser. No. 12/319,047. The disclosure of the respective above-identified application is incorporated herein by reference.

BACKGROUND

1. Technical Field

The invention relates to an electron emission device and a display device using the electron emission device.

2. Discussion of Related Art

Electron emission displays are new, rapidly developing in flat panel display technologies. Compared to conventional technologies, e.g., cathode-ray tube (CRT) and liquid crystal display (LCD) technologies, Field Electron emission Displays (FEDs) are superior in having a wider viewing angle, low energy consumption, a smaller size, and a higher quality display.

Generally, FEDs can be roughly classified into diode type structures and triode type structures. Diode type FEDs has only two electrodes, a cathode and an anode. Diode type FEDs can be used for character display, but are unsatisfactory for applications requiring high-resolution display images, because of they are relatively non-uniform and there is difficulty in controlling their electron emission.

Triode type FEDs were developed from the diode type by adding a gate electrode for controlling electron emission. Triode type FEDs can emit electrons at relatively lower voltages. A conventional triode type electron emission device includes a cathode electrode, a gate electrode spaced from the cathode electrode. Generally, an insulating layer is deposited on the cathode electrode for supporting the gate electrode, e.g., the gate electrode is formed on a top surface of the insulating layer. The cathode electrode includes an emissive material, such as carbon nanotube (CNT). The gate electrode includes a plurality of holes toward the emissive material, these holes are called gate holes. In use, different voltages are applied to the cathode electrode and the gate electrode. Electrons are emitted from the emissive material, and then travel through the gate holes in the gate electrode.

The conventional gate electrode is a metal grid, the metal grid has a plurality of gate holes. The smaller size gate holes make for a more efficient high-resolution electron emission device. Generally, the metal grid can be fabricated using screen-printing or chemical etching methods. Areas of the gate holes in the metal grid are often more than 100 $\mu m^2$, so the electron emission device cannot satisfy some needs requiring great accuracy. The uniformity of the electric field cannot be improved by decreasing the size of the gate holes because of technics limits, and thus, restricts the performance of electron emission. Further, the method for making the metal grid requires an etching solution, and the etching solution may be harmful to the environment. Additionally, the grid made by metal material is relatively heavy, and restricts applications of the electron emission device.

What is needed, therefore, is an electron emission device and a display device using the same having high efficiency, high-resolution and light weight.

BRIEF DESCRIPTION OF THE DRAWINGS

Many aspects of the electron emission device and the display device can be better understood with references to the following drawings. The components in the drawings are not necessarily drawn to scale, the emphasis instead being placed upon clearly illustrating the principles of the present electron emission device and the display device.

Corresponding reference characters indicate corresponding parts throughout the several views. The exemplifications set out herein illustrate at least one embodiment of the present electron emission device and display device using the same.

DETAILED DESCRIPTION OF EXEMPLARY EMBODIMENTS

References will now be made to the drawings to describe the exemplary embodiments of the electron emission device and display device using the same, in detail.

Figure 1:
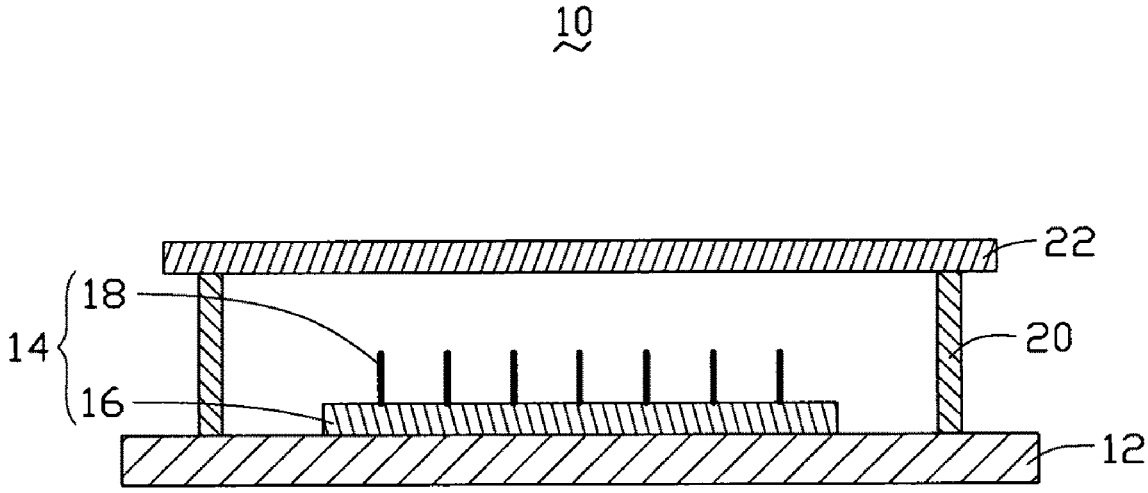
FIG. 1 is a schematic, cross-sectional view, showing an electron emission device, in accordance with a present embodiment.

Referring to FIG. 1, an electron emission device 10 includes a substrate 12, a cathode electrode 14, and an insulating supporter 20. The cathode electrode 14 and the insulating supporter 20 are disposed on the substrate 12. Further included is a gate electrode 22 formed on a top surface of the insulating supporter 20. The gate electrode 22 is electrically insulted from the cathode electrode 14 by the insulating supporter 20.

The substrate 12 comprises of an insulating material, such as glass, silicon, ceramic, etc. The substrate 12 is used to support the cathode electrode 14. The shape of the substrate 12 can be determined according to practical needs. In the present embodiment, the substrate 12 is a ceramic substrate.

The cathode electrode 14 can be a field emission cathode electrode or a hot emission cathode electrode, the detailed structure of the cathode electrode 14 is not limited. The cathode electrode 14 includes at least one electron emitter. When more than one electron emitter 18 is used, they can be configured to form an array or any other pattern. In the present embodiment, the cathode electrode 14 is a field emission cathode electrode. The cathode electrode 14 includes a conductive layer 16 and a plurality of electron emitters 18 disposed thereon. The conductive layer 16 is located on the substrate 12. The electron emitters 18 are electrically connected to the conductive layer 16. The material of the conductive layer 16 can be made of metal, alloy, indium tin oxide (ITO) or any other suitable conductive materials. The electron emitters 18 can be selected from the group of silicon needles, metal needles or CNTs. In the present embodiment, the conductive layer 16 is an ITO film, the electron emitters 18 are CNTs.

The insulating supporter 20 is used to support the gate electrode 22. The detailed shape of the insulating supporter 20 is not limited; the only requirement is that the gate electrode 22 and the cathode electrode 14 are insulated from each other. The insulating supporter 20 is made of an insulating material, such as glass, silicon, ceramic, etc. In the present embodiment, the insulating supporters 20 comprised of glass. The insulating supporter 20 is a frame disposed around the cathode electrode 14 and can be perpendicular to the cathode electrode 14.

Figure 2:
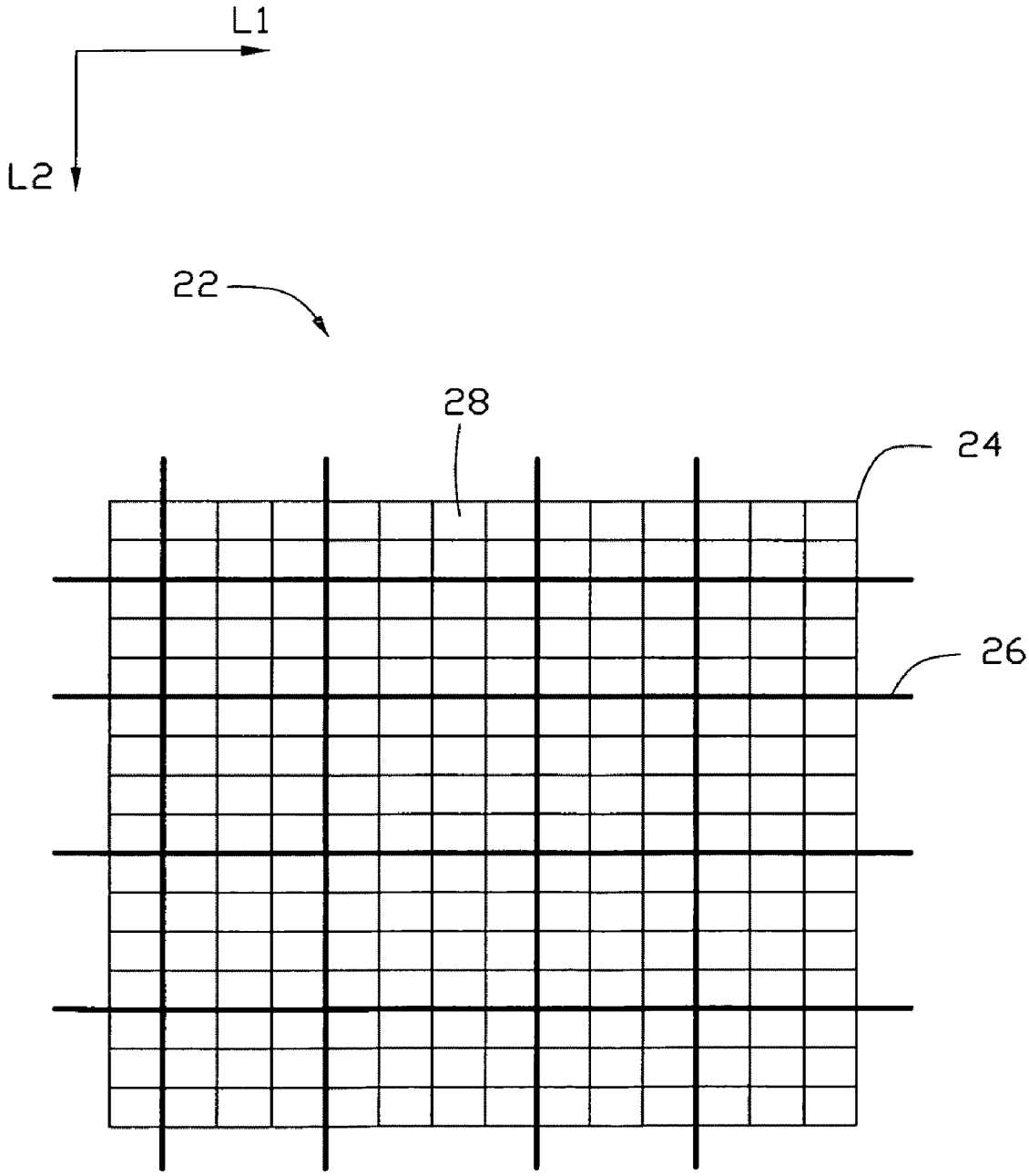
FIG. 2 is a schematic, top view, showing gate structure using a CNT layer, used in the electron emission device of FIG. 1.

Referring FIG. 2, the gate electrode 22 includes a CNT layer. The CNT layer includes at least a CNT film 24 and a plurality of CNT cables 26. The CNT cables 26 are distributed on at least a surface of the CNT films. The CNT cables 26 are used to enhance the mechanical strength of the gate electrode 22. In other embodiments, CNT wires can be used in place of the CNT cables 26. The gate electrode 22 with CNT cables 26 is stronger and has a longer lifetime. The CNT layer includes a plurality of spaces 28. The spaces 28 are used as the gate holes. When the CNT layer includes one CNT film, the spaces 28 are the linear spaces between two adjacent CNTs. When the CNT layer includes two or more CNT films set at an angle to each other, the spaces 28 are defined by the crossed CNTs in two adjacent CNT films. The spaces 28 are formed in a substantially uniform manner in the CNT layer. Each of the spaces is ranges from about 1 $nm^2$ to about 100 $\mu m^2$. The spaces have almost the same areas. The thickness of the CNT layer is in a range from about 50 nm to about 500 μm.

The CNT layer is free-standing and includes one CNT film 24 or several layers of CNT films 24 stacked therewith. Each CNT film 24 includes a plurality of CNTs arranged along a same direction (e.g., collinear and/or parallel). The CNTs in the CNT film 24 are joined end to end by van der Waals attractive force therebetween. Each CNT film 24 includes a plurality of successively oriented CNT segments joined end to end by van der Waals attractive force therebetween. Each CNT segment includes a plurality of CNTs parallel to each other, and combined by van der Waals attractive force therebetween. The CNT segments can vary in width, thickness, uniformity and shape. When the CNT layer includes at least two CNT films 24, the CNTs in different CNT films can be aligned along a same direction, or aligned at different directions. An angle $\alpha$ between the alignment directions of the CNTs between adjacent CNT films is in the range of $0° \leqq \alpha \leqq 90°$. A length and a width of the CNT film 24 can be arbitrarily set as desired. A thickness of the CNT film 24 is in a range from about 50 nm to about 500 μm. In other embodiments, the CNT layer may include two or more CNT films aligned along a first direction on top or on bottom of one or more CNT films aligned along a common direction that is different from the first direction.

The CNT layer also includes a plurality of CNT reinforcement structures. The CNT reinforcement structures can be CNT wires or cables 26. The CNT cables 26, shown in the Figures, are distributed on or below the CNT films 24. The CNT cables 26 can be knitted, waved, crossed or overlapped to form a net structure. The CNT cables 26 in the net structure can be aligned respectively along a first direction L1 and a second direction L2. The CNT cables 26 aligned along each direction are spaced at a uniform distance therebetween. In other embodiments, the CNT cables 26 can also be parallel with each other, aligned along several directions and/or have different distances between them. An angle $\beta$ between the L1 and L2 is in the range from 0 degrees to about 90 degrees.

Figure 3:
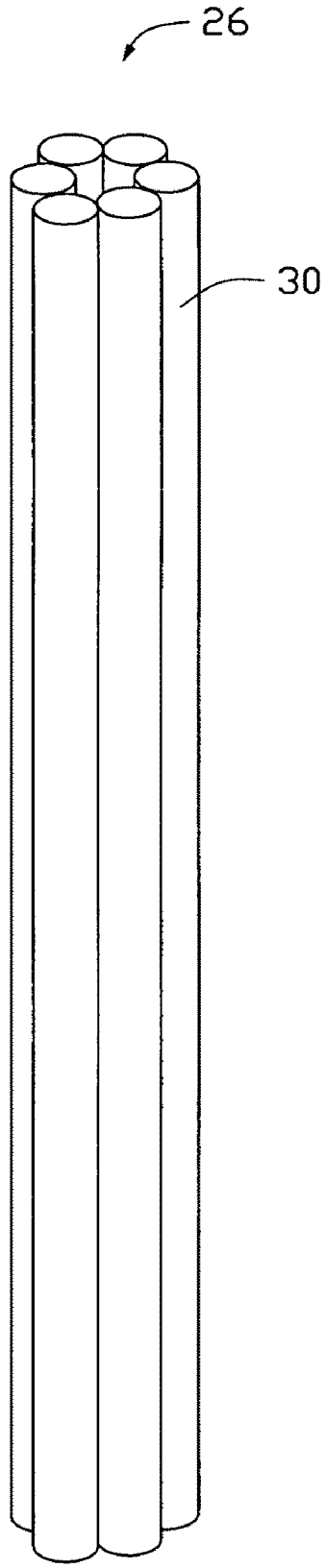
FIG. 3 is a schematic view of a CNT cable in which the CNT wires are parallel.
Figure 4:
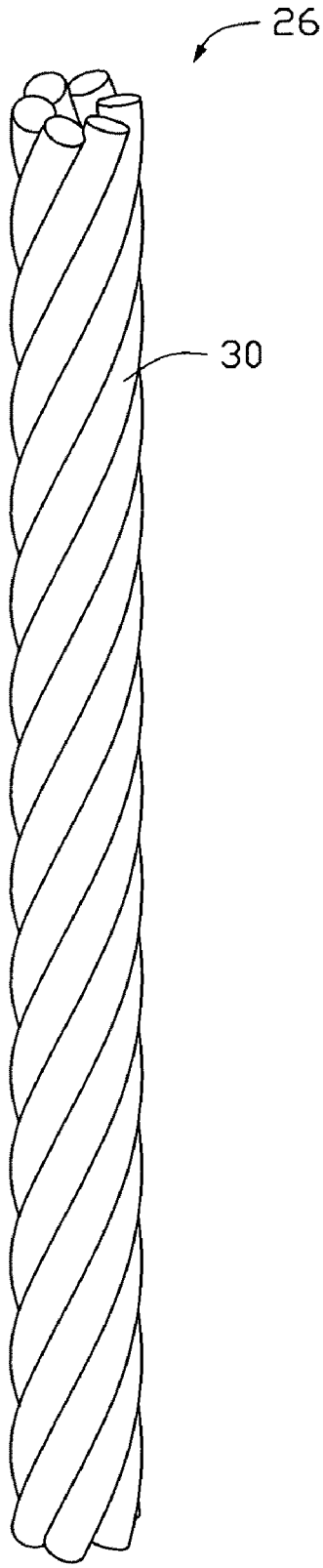
FIG. 4 is a schematic view of a CNT cable in which the CNT wires are twisted.

Referring FIGS. 3 and 4, the CNT cable 26 includes at least two CNT wires 30. The CNT wires 30 in the CNT cable 26 can be parallel with each other, as shown in FIG. 3, or twisted with each other, as shown in FIG. 4. The CNT wire 30 includes a plurality of successive and oriented CNTs joined end to end by van der Waals attractive force.

Figure 5:
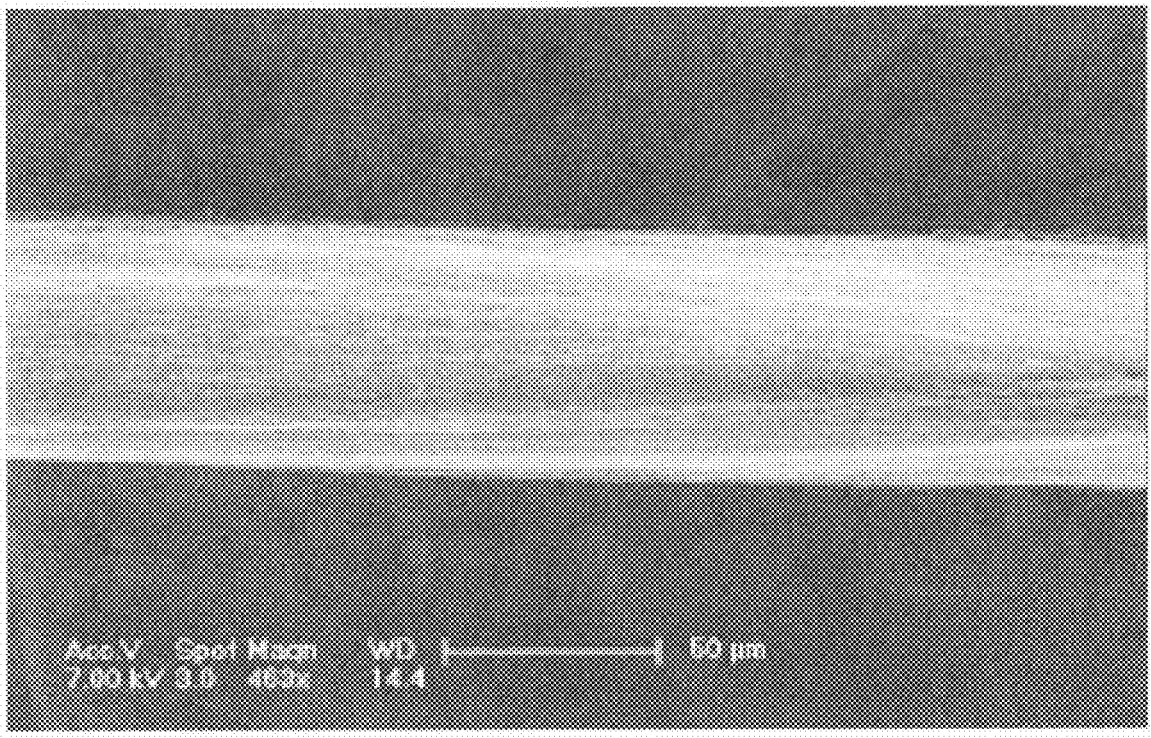
FIG. 5 is a Scanning Electron Microscope (SEM) image of an untwisted CNT wire.
Figure 6:
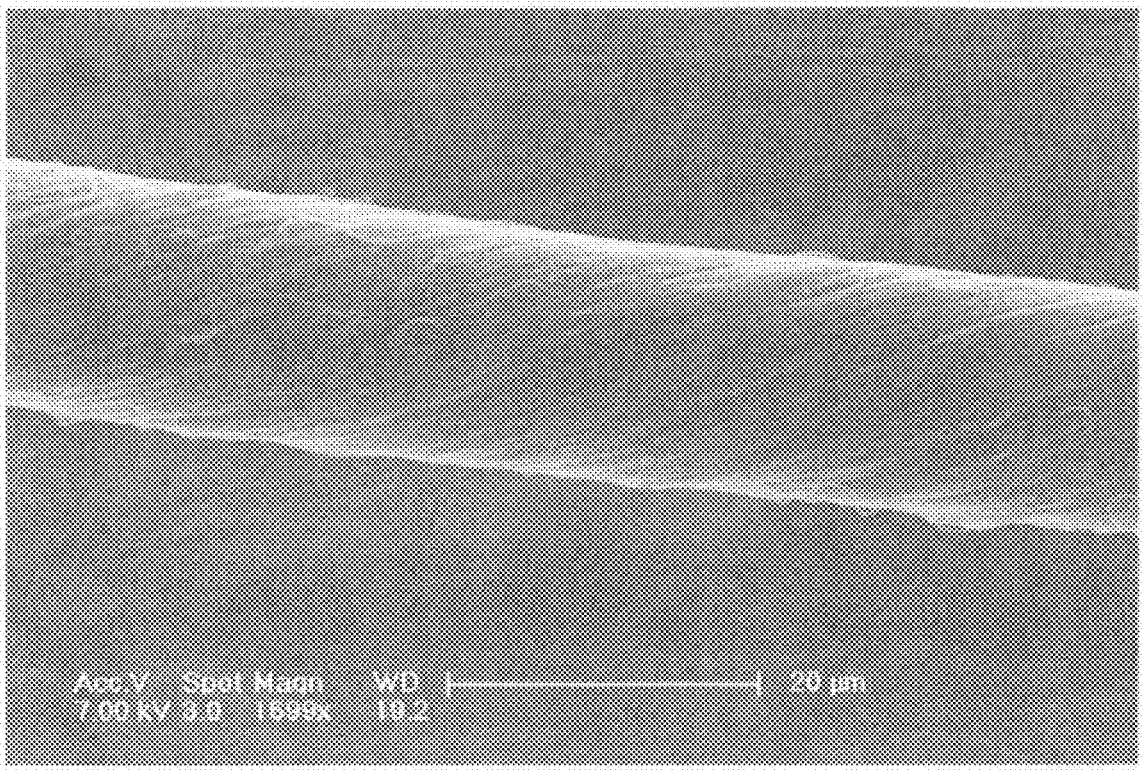
FIG. 6 is a Scanning Electron Microscope (SEM) image of a twisted CNT wire.

The CNT wire 30 used in the cables 26 can be twisted or untwisted. Referring to FIG. 5, the untwisted CNT wire 30 includes a plurality of CNTs oriented along a same direction (e.g., a direction along the length (axis) of the wire 30). Referring to FIG. 6, the twisted CNT wire 30 includes a plurality of CNTs oriented around an axial direction of the CNT wire 30. More specifically, the CNT wire 30 includes a plurality of successive CNTs joined end to end by van der Waals attractive force therebetween. Length of the CNT wire 30 can be set as desired. A diameter of the CNT wire 30 is in a range from about 50 nm to about 500 μm.

The CNTs in the CNT wires 30 and/or the CNT films 24 can be selected from a group consisting of single-walled, double-walled, and multi-walled CNTs. A diameter of each single-walled CNT ranges from about 0.5 nm to about 50 nm. A diameter of each double-walled CNT ranges from about 1 nm to about 50 nm. A diameter of each multi-walled CNT ranges from about 1.5 nm to about 50 nm. A length of the CNTs in the CNT wire 30 can be in the range from about 1 nm to about 5000 μm. In the present embodiment, the length of the CNTs is about 10 μm.

In operation, different voltages can be respectively applied to the cathode electrode 14 and the gate electrode 22 (Usually, the voltage of the cathode electrode 14 is zero and may be electrically connected to ground. The voltage of the gate electrode 22 is positive and ranges from tens of volts to hundreds of volts). The electrons can be extracted from the cathode electrode 14 by an electric field generated by the gate electrode 22 and the cathode electrode 14, and then the electrons travel through the spaces 24 in the gate electrode 22. In the present embodiment, the gate electrode 22 is a CNT layer. The CNT layer includes a plurality of spaces 24. The area of the spaces 24 is ranged from about 1 $nm^2$ to about 2 $mm^2$. The spaces are substantially uniformly distributed and have small areas. Therefore, a uniform electric field can be formed between the cathode electrode 14 and the gate electrode 22. Thus, the electron emission device and the display device using the same have a high efficiency and a high-resolution. Further, due to the CNT layer having a lower density compared with metal, the electron emission device 10 is relatively light, and the electron emission device 10 can be easily used in a broader range of technologies.

Figure 7:
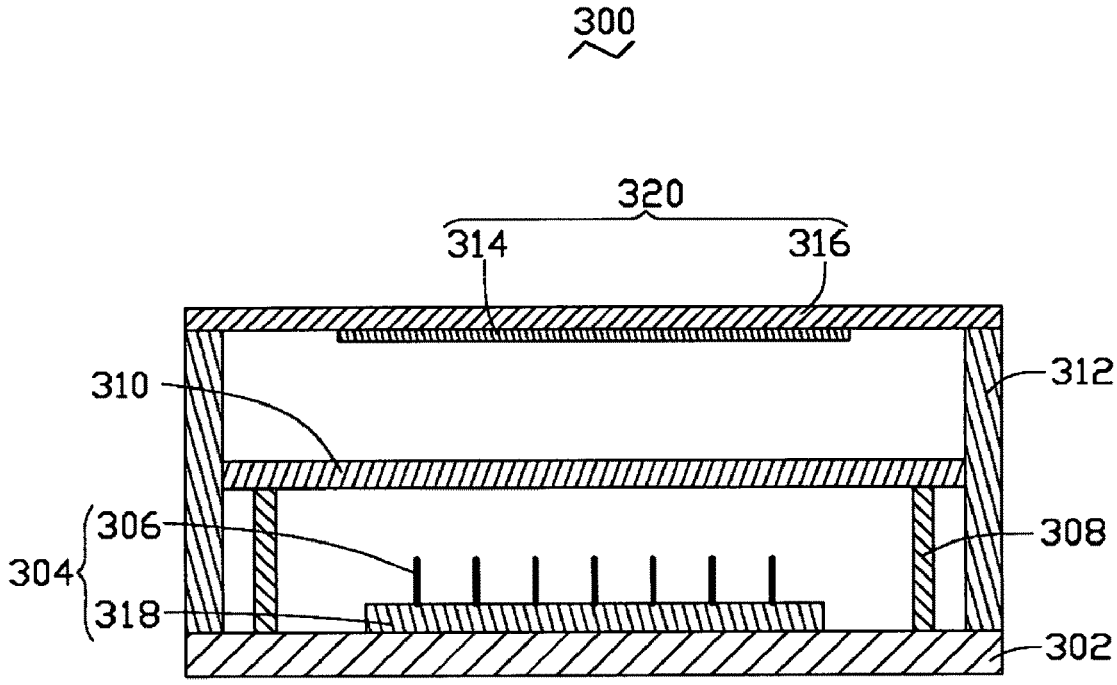
FIG. 7 shows is a schematic, cross-sectional view, showing a display device, in accordance with a present embodiment.

Referring to FIG. 7, a display device 300 employing the above-described electron emission device 10, according to another embodiment, is shown. The display device 300 includes a substrate 302, a cathode electrode 304 and a first insulating supporter 308 disposed on the substrate 302, a gate electrode 310 formed on a top surface of the first insulating supporter 308. The gate electrode 310 is electrically insulated from the cathode electrode 14 by the first insulating supporter 308. Further included are a second insulating supporter 312, disposed on the substrate 302, and an anode device 320 formed on a top surface of the second insulating supporter 312. The anode device 320 is electrically insulated from the cathode electrode 304 and the gate electrode 310 by the second insulating supporter 312.

The second insulating supporter 312 is used to support the anode device 320. The detailed shape of the second insulating supporter 312 is not limited, as long as the anode device is insulated from the cathode electrode 304 and the gate electrode 310. The second insulating supporter 312 can be made of an insulation material, such as glass, silicon, ceramic, etc. In the present embodiment, the second insulating supporter 312 is made of glass. The second insulating supporter 312 is disposed on the substrate 302 and is longer than the first insulating supporter 308.

The anode device 320 includes an anode electrode 314 and a fluorescence layer 316. The anode device 320 is above the gate electrode 310. The fluorescence layer 316 is on a surface of the anode electrode 314 facing the gate electrode. The fluorescence layer 316 can be formed by a coating method.

The cathode electrode 304 can be field emission cathode electrode or hot emission cathode electrode. The detailed structure of the cathode electrode 304 is not limited. The cathode electrode includes at least one electron emitter 306. The structure of electron emitter is not limited, and can be one or more films or an array. In the present embodiment, the cathode electrode 304 is field emission cathode electrode. The cathode electrode 314 includes a conductive layer 318 and a plurality of electron emitters 306 dispose thereon. The conductive layer 318 lays on the substrate 302, the electron emitters 306 are electrically connected to the conductive layer 318. The material of the conductive layer 318 is made of metal or any other suitable conductive materials. The electron emitters 306 can be selected from the group of silicon needles, metal needles or CNTs. In the present embodiment, the conductive layer 318 is an ITO film, and the electron emitters 306 are CNTs.

The gate electrode 310 is a CNT layer. The structure of the CNT layer is similar to the CNT layer used in the electron emission device 10. The CNT layer includes a plurality of spaces. The spaces serve as gate holes. The spaces are distributed substantially uniformly in the CNT layer. The area of the spaces ranges from about 1 $nm^2$ to about 2 $mm^2$. The thickness of the CNT layer is in a range from about 50 nm to about 500 μm.

In operation, different voltage can be respectively applied to the anode electrode 314, the cathode electrode 304 and the gate electrode 310 (e.g., the voltage of the cathode electrode 14 is zero or the cathode electrode 14 is electrically connected to the earth. The voltage of the gate electrode 22 is positive). The electrons can be extracted from the cathode electrode 314 by an electric field generated by gate electrode 310 and the cathode electrode 314, and then the electrons travel through the spaces in the gate electrode 310, then reaches the fluorescence layer 316 on the surface of the anode electrode 314, the fluorescence layer 316 emitting visible-lights. As the gate electrode 310 is a CNT layer, the CNT layer includes a plurality of spaces. Each of the spaces is ranges from about 1 $nm^2$ to about 2 $mm^2$. The spaces are distributed substantially equally and have small areas, so the electron emission device and the display have a high efficiency and a high-resolution. The CNT layer has a lower density compared with metal, the electron emission device 10 has a lower quality, the display can be used easily in a broad field.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. An electron emission device, comprising:

a cathode electrode; and a gate electrode insulated from the cathode electrode, the gate electrode comprising a carbon nanotube layer having a plurality of substantially uniformly distributed spaces, the carbon nanotube layer comprising at least one carbon nanotube film and a plurality of carbon nanotube reinforcement structures.

2. The electron emission device as claimed in claim 1, wherein cathode electrode is a field emission cathode electrode or a hot emission cathode electrode.

3. The electron emission device as claimed in claim 1, wherein an area of each space ranges from about 1 $nm^2$ to about 2 $mm^2$.

4. The electron emission device as claimed in claim 1, wherein a thickness of the carbon nanotube layer ranges from about 50 nm to about 500 μm.

5. The electron emission device as claimed in claim 1, wherein the carbon nanotube film comprises a plurality of successively oriented carbon nanotube segments joined end-to-end by van der Waals attractive force therebetween.

6. The electron emission device as claimed in claim 5, wherein each carbon nanotube segment comprises a plurality of carbon nanotubes parallel to each other and combined by van der Waals attractive force therebetween.

7. The electron emission device as claimed in claim 1, wherein a thickness of each of the carbon nanotube film ranges from about 50 nm to about 500 μm.

8. The electron emission device as claimed in claim 1, wherein the carbon nanotube layer includes two or more stacked carbon nanotube films.

9. The electron emission device as claimed in claim 8, wherein the carbon nanotubes of adjacent carbon nanotube films intersect an angle ranging from about 0 degrees to about 90 degrees.

10. The electron emission device as claimed in claim 1, wherein the carbon nanotube reinforcement structures comprise some carbon nanotube reinforcement structures parallel to each other and arranged along a first direction, and some carbon nanotube reinforcement structures parallel to each other and arranged along a second direction, and an angle made by the first direction and the second direction ranges from about 0 degrees to about 90 degrees.

11. The electron emission device as claimed in claim 1, wherein the reinforcement structures comprise a plurality of carbon nanotube cables, and each carbon nanotube cable comprises at least two carbon nanotube wires.

12. The electron emission device as claimed in claim 11, wherein the at least two carbon nanotube wires are parallel with each other or twisted with each other.

13. The electron emission device as claimed in claim 11, wherein a diameter of the carbon nanotubes wires ranges from about 50 nm to about 500 μm.

14. The electron emission device as claimed in claim 11, wherein the carbon nanotube wires are twisted.

15. The electron emission device as claimed in claim 11, wherein the carbon nanotube wires comprise a plurality of successive carbon nanotubes, which are oriented along or around an axial direction of the carbon nanotube wire.

16. The electron emission device as claimed in claim 15, wherein the carbon nanotubes in the carbon nanotube wires are joined end-to-end.

17. A display device, comprising:

a cathode electrode;

an anode electrode spaced from the cathode electrode; and a gate electrode disposed between the cathode electrode and the anode electrode;

wherein the cathode electrode, the anode electrode and the gate electrode are insulated from each other, the gate electrode comprises a carbon nanotube layer having a plurality of substantially uniformly distributed spaces, and the carbon nanotube layer comprises at least one carbon nanotube film and a plurality of carbon nanotube reinforcement structures.

18. The display device as claimed in claim 17, wherein an area of each spaces ranges from about 1 $nm^2$ to about 2 $mm^2$.

19. The display device as claimed in claim 17, wherein the cathode electrode is a field emission cathode electrode or a hot emission cathode electrode.

20. The display device as claimed in claim 17, wherein a thickness of the carbon nanotube layer ranges from about 50 nm to about 500 μm.

* * * * *